US005194132A

United States Patent [19]

Hartmann et al.

[11] Patent Number: 5,194,132

[45] Date of Patent: Mar. 16, 1993

[54] ELECTROLYSIS APPARATUS

[75] Inventors: Manfred Hartmann, Bad Camberg; Dieter Bergner; Kurt Hannesen, both of Kelkheim, all of Fed. Rep. of Germany

[73] Assignee: Hoechst Aktiengesellschaft, Fed. Rep. of Germany

[21] Appl. No.: 913,149

[22] Filed: Jul. 14, 1992

[30] Foreign Application Priority Data

Jul. 16, 1991 [DE] Fed. Rep. of Germany ..... 4123514

[51] Int. Cl.[5] ..... C25B 9/00; C25B 11/03; C25B 15/08

[52] U.S. Cl. ..... 204/257; 204/263; 204/283; 204/284

[58] Field of Search ..... 204/252-258, 204/263-266, 282-283, 284

[56] References Cited

U.S. PATENT DOCUMENTS 4,322,281 3/1982 Wright et al. ..... 204/257 X
4,378,286 3/1983 Eng et al. ..... 204/257
4,839,012 6/1989 Burney, Jr. et al. ..... 204/257 X
5,139,635 8/1992 Signorini ..... 204/266 X

*Primary Examiner*—Donald R. Valentine
*Attorney, Agent, or Firm*—Connolly & Hutz

[57] ABSTRACT

In the electrolysis apparatus for the production of chlorine, sodium hydroxide solution and hydrogen from aqueous alkali-metal halide solutions, which electrolysis apparatus comprises at least one electrolysis cell, anode and cathode, which are separated from one another by a partition, are disposed in a housing composed of two half-shells electrically separated by an insulating seal. The housing is provided with devices for supplying the electrolysis starting substances and for removing the electrolysis products, the latter comprising at least one discharge pipe which extends in the vertical direction in the interior of the half-shells, passes through the half-shell in the vicinity of the lower edge and extends up to the upper edge. The discharge pipe (9, 10) terminates in a separating chamber (14, 15) which is disposed in a stilling zone. The stilling zone is formed by a plate (11, 12) attached to the electrode (4, 5) and to the associated half-shell (1, 2).

8 Claims, 3 Drawing Sheets

ELECTROLYSIS APPARATUS

The invention relates to an electrolysis apparatus for the production of chlorine, sodium hydroxide solution and hydrogen from aqueous alkali-metal halide solutions, which electrolysis apparatus comprises at least one electrolysis cell whose anode and cathode, which are separated from one another by a partition, are disposed in a housing composed of two half-shells separated by an insulating seal and in which electrolysis apparatus the housing is provided with devices for supplying the electrolysis starting substances and for removing the electrolysis products, the latter comprising at least one discharge pipe which extends in the vertical direction in the interior of the half-shells, passes through the half-shell in the vicinity of the lower edge and extends up to the upper edge.

German Offenlegungsschrift 2,909,640 discloses such an appliance, in which two separate half-shells composed of suitable materials are insulated, screwed together and separated from one another by a membrane. The current is supplied in a punctiform manner via electrically conducting bolts fed through the rear walls of the half-shells.

EP-B-0,189,535 discloses a similar electrolysis cell, in which the current is supplied via longitudinal contacts to the rear walls of the half-shells and from there, via corrugated strips, to the electrodes. The electrodes are of slatted construction.

In both constructions, the electrolytes and the gases are removed from each half-shell by a riser pipe in each case, the latter passing from the lower side of the half-shell through the cell base in a liquid-tight manner and leading, inside the half-shell almost up to the upper edge, to the cell roof. For constructional reasons, these riser pipes have a diameter which is limited by the depth of the half-shell. A disadvantage is that, with electrode areas of over 2 $m^2$ and current densities of over 4 $kA/m^2$, rocking movements are produced in the electrolytes and, associated therewith, non-uniform discharge of gas and electrolyte. If the membrane is consequently not sufficiently wetted by the electrolytes, damage to the membrane occurs. Such damage to the membrane in the upper part of the cell has to be avoided because it forces the operator to replace the entire membrane, and this implies not only production outage and assembly activities, but also a cost-intensive repurchase of the perfluorinated ion exchanger membrane. Furthermore, damage to the membrane in the upper part of the cell can result in an embrittlement and subsequent formation of pores or cracks, as a result of which a mixing of the products is possible, and in the production of hydrogen/chlorine mixtures this can result in an explosion.

It is here that the invention aims to provide a remedy.

The invention achieves the object by the electrolysis apparatus, mentioned at the outset, wherein the discharge pipe terminates in a separating chamber, which is disposed in a stilling zone formed by a plate attached to the electrode and to the associated half-shell.

The plate may be to 2 to 10 cm high. The separating chamber should be designed to be at least 5 cm wide, 2.5 cm deep and 3 cm high; its upper edge may be provided with an overflow weir and the discharge pipe may project up to half the chamber height into the separating chamber. The anode half-shells may be composed of an electrically conductive material which is resistant to chlorine and the cathode half-shells of an electrically conductive material which is resistant to alkali-metal hydroxide solutions. The electrodes may be manufactured from expanded metal, perforated metal sheets, punched slats or rod material and connected in an electrically conducting manner to their half-shells via corrugated strips.

The present invention results in a protection of the membrane in the upper region of the cell, in a stilling of the foam zone and in a liquid/gas separation before entry into the discharge pipe and it consequently enables the operation of large components with current densities of over 4 $kA/m^2$. The electrolysis cell according to the invention is shown in FIGS. 1 to 3 in an exemplary design.

In the figures

Figure 1:
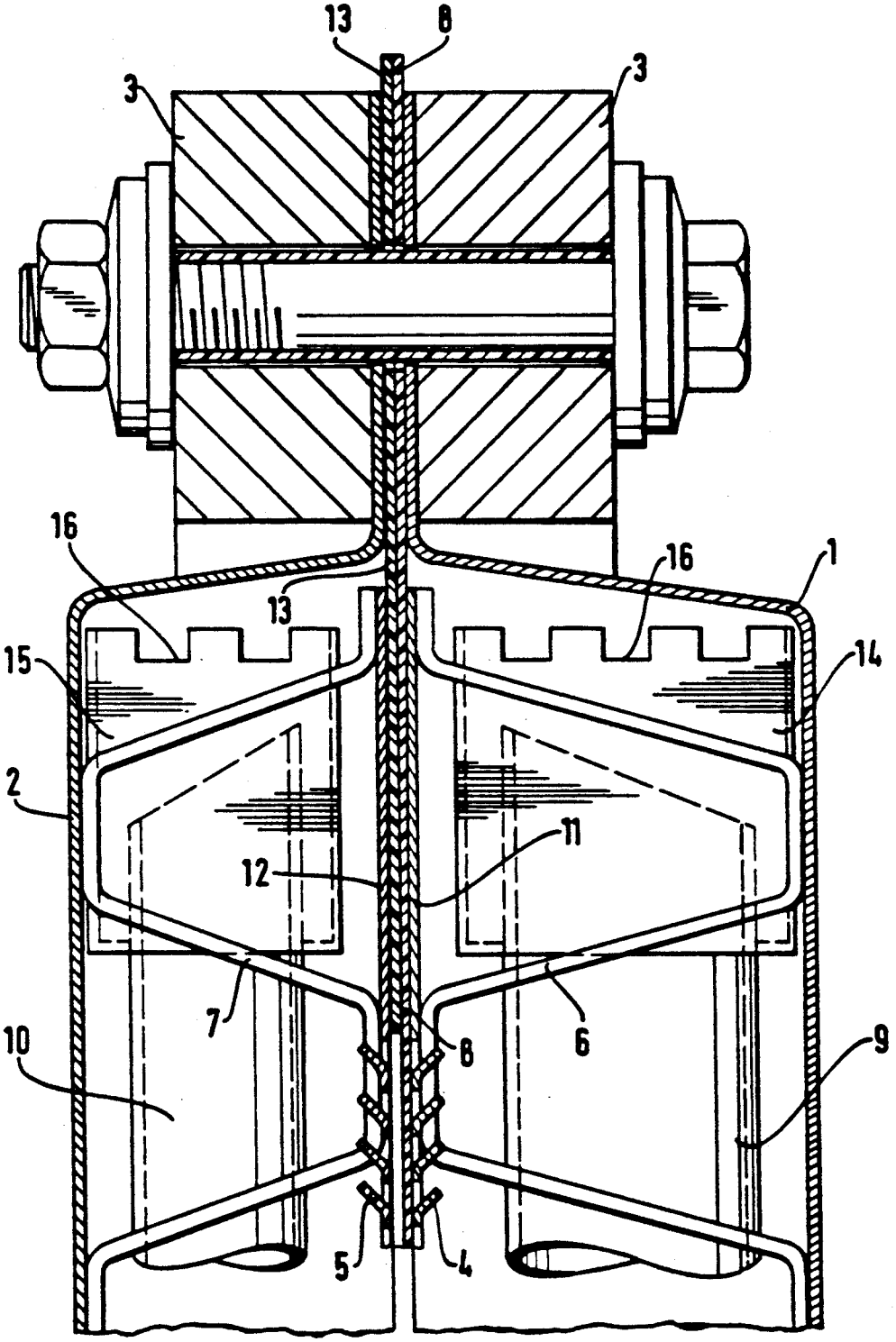
FIG. 1 shows a section through the upper part of the electrolysis cell.
Figure 2:
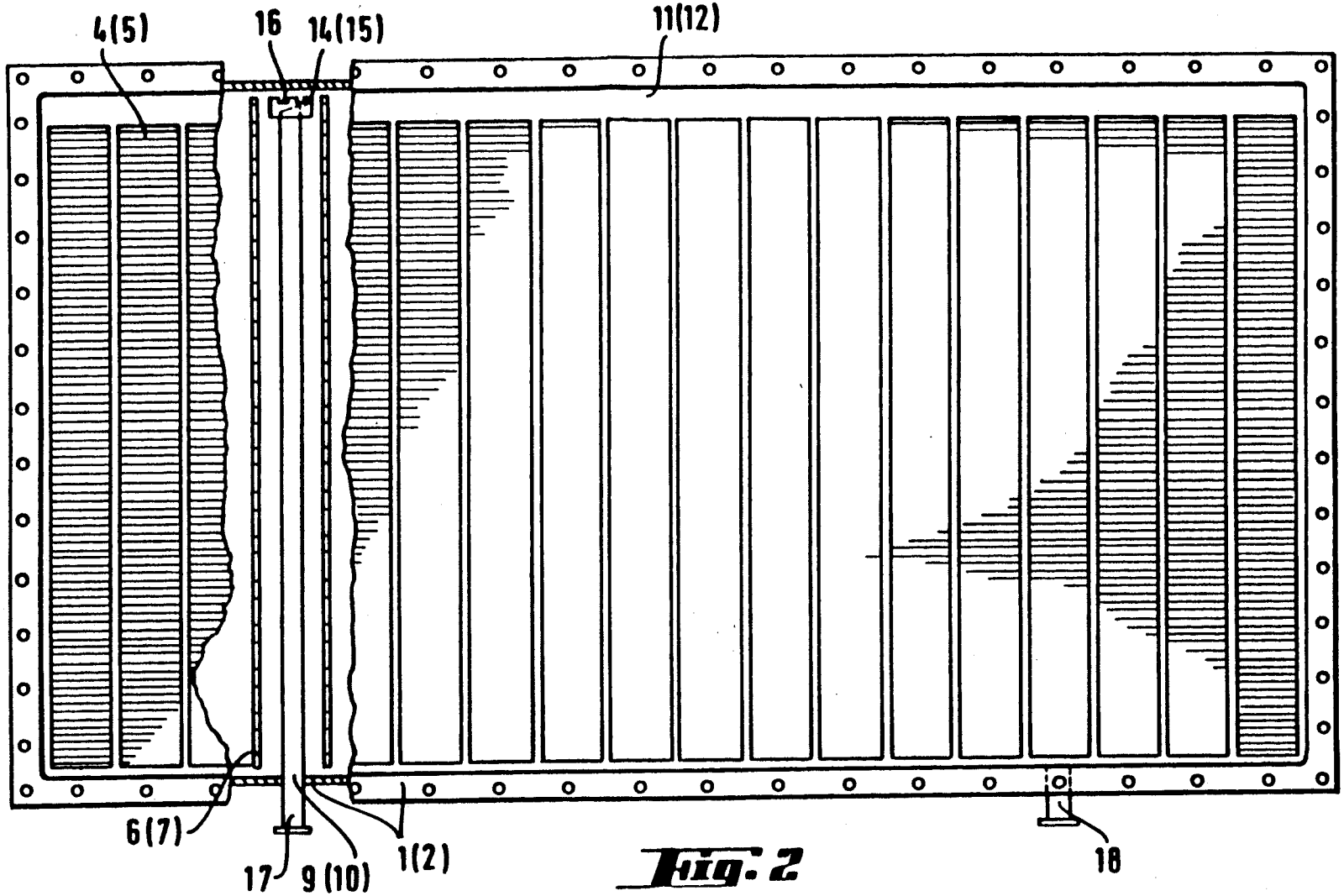
FIG. 2 shows a half-shell of the housing with partly cut-away slatted electrodes in elevation.
Figure 3:
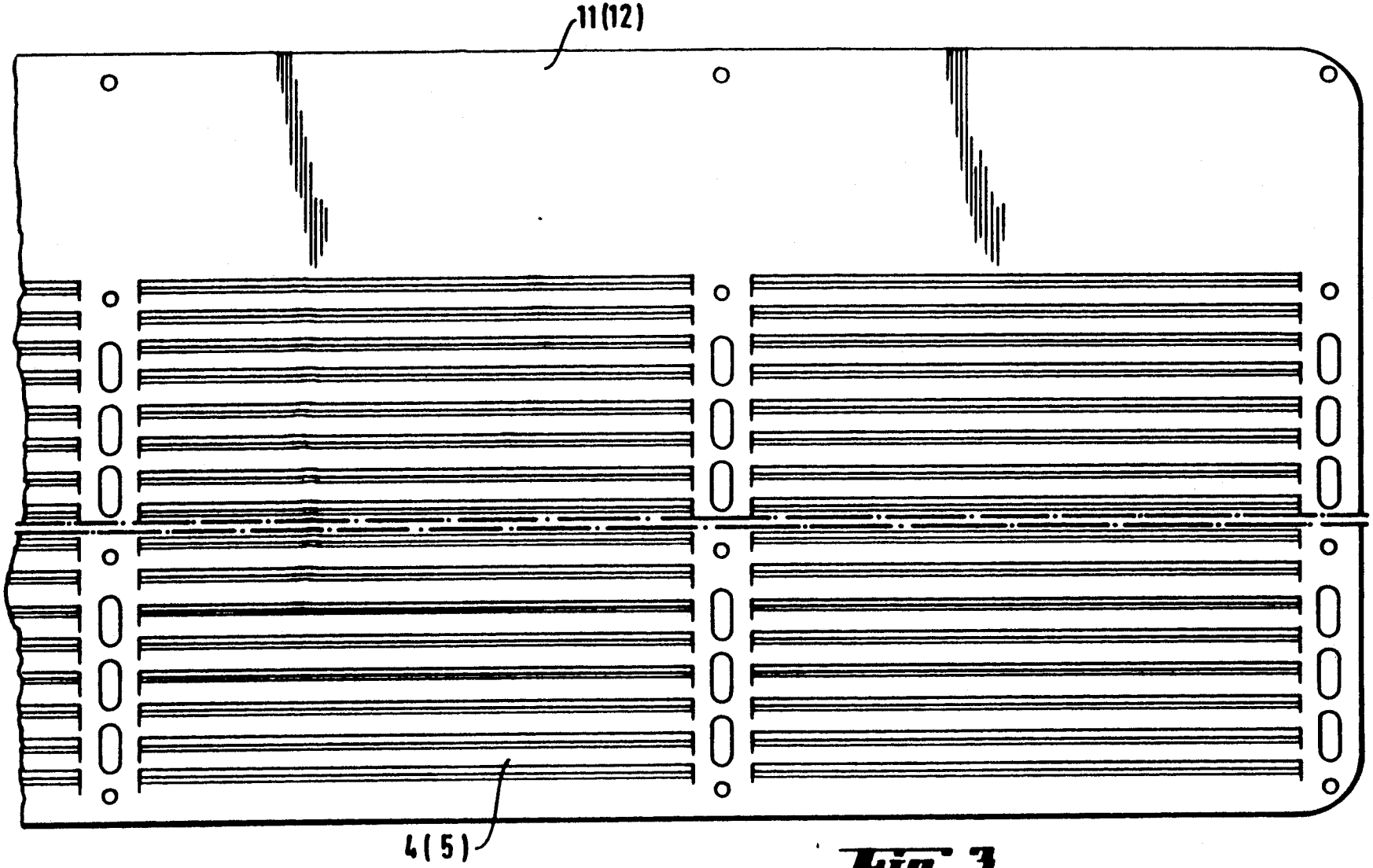
FIG. 3, shows an electrode in elevation.

The titanium anode half-shell (1) is screwed to the nickel or steel cathode half-shell (2) by means of a separate flange (3). The anode (4) and the cathode (5) are connected in an electrically conducting manner to the rear wall of the respective half-shell via titanium corrugated strips (6) and nickel or steel corrugated strips (7). Situated between the electrodes (4, 5) is the partition (8), an ion exchanger membrane, for example Nafion ® supplied by the Du Pont company, Flemion ® supplied by the Asahi Glass company or Aciplex ® supplied by the Asahi Chemical company. The starting electrolyte solutions, sodium hydroxide solution and salt solution, are fed to the electrolysis cell at the base of the cell via feed pipes (18). The electrolysis products are removed from the cell in a downward direction via the discharge pipes (9 and 10). The discharge pipes (9, 10) each terminate in a separating chamber (14, 15). The separating chambers (14, 15) are at least 5 cm wide, 2.5 cm deep and 3 cm high. Their upper edge is provided with overflow weirs (16). The separating chambers (14, 15) are each disposed in a stilling zone which is formed by plates (11, 12) attached in each case to the electrodes (4, 5) and to the associated half-shells (1, 2). No current flows through the covered part of the membrane (8) and the membrane is therefore protected in this part of the cell, even if a gas zone without electrolyte should form at this point. The seal (13) disposed between the flange parts (3) projects into the interspace formed by the two plates (11, 12). The plates (11, 12) may also be an integral component of the electrodes (4, 5), as shown in FIG. 3. (17) indicates the connecting pieces for the discharge tubes (9 and 10).

We claim:

1. An electrolysis apparatus for the production of chlorine, sodium hydroxide solution and hydrogen from aqueous alkali-metal halide solutions, which electrolysis apparatus comprises at least one electrolysis cell whose anode and cathode, which are separated from one another by a partition, are disposed in a housing composed of two half-shells separated by an insulating seal and in which electrolysis apparatus the housing is provided with devices for supplying the electrolysis starting substances and for removing the electrolysis products, the latter comprising at least one discharge pipe which extends in the vertical direction in the interior of the half-shells, passes through the half-shell in the vicinity of the lower edge and extends up to the upper edge, wherein the discharge pipe (9, 10) terminates in a separating chamber (14, 15) which is disposed in a stilling zone formed by a plate (11, 12) attached to the electrode (4, 5) and to the associated half-shell (1, 2).

2. The electrolysis apparatus as claimed in claim 1, wherein the plate (11, 12) is 2 to 10 cm high.

3. The electrolysis apparatus as claimed in claim 1, wherein the separating chamber (14, 15) is designed to be at least 5 cm wide, 2.5 cm deep and 3 cm high, its upper edge is provided with overflow weirs (16) and the discharge pipe (9, 10) projects up to half the chamber height into the separating chamber (14, 15).

4. The electrolysis apparatus as claimed in claim 1, wherein the insulating seal (13) projects at the upper edge of the cell into the gap formed by the plates (11, 12).

5. The electrolysis apparatus as claimed in claim 1, wherein the anode half-shells (1) are composed of an electrically conductive material which is resistant to chlorine.

6. The electrolysis apparatus as claimed in claim 1, wherein the cathode half-shells (2) are composed of an electrically conductive material which is resistant to sodium hydroxide solution.

7. The electrolysis apparatus as claimed in claim 1, wherein the electrodes (4, 5) are composed of expanded metal, perforated metal sheets, punched slats o rod material.

8. The electrolysis apparatus as claimed in claim 1, wherein the electrodes (4, 5) are connected in an electrically conducting manner to their half-shells (1, 2) via corrugated strips (6, 7).

* * * * *

UNITED STATES PATENT AND TRADEMARK OFFICE

CERTIFICATE OF CORRECTION

PATENT NO. :5,194,132
DATED :March 16, 1993
INVENTOR(S) :Manfred Hartmann, et. al.

It is certified that error appears in the above-indentified patent and that said Letters Patent is hereby corrected as shown below:

Column 4, line 11, "o" should read -- or --.

Signed and Sealed this

Thirtieth Day of November, 1993

Bruce Lehman

*Attest:*

BRUCE LEHMAN

*Attesting Officer*

*Commissioner of Patents and Trademarks*